US008492635B2

(12) United States Patent
Nakanishi

(10) Patent No.: US 8,492,635 B2
(45) Date of Patent: Jul. 23, 2013

(54) MUSIC SOUND GENERATION APPARATUS, MUSIC SOUND GENERATION SYSTEM, AND MUSIC SOUND GENERATION METHOD

(75) Inventor: Masahiro Nakanishi, Kyoto (JP)

(73) Assignee: Panasonic Corporation, Osaka (JP)

( * ) Notice: Subject to any disclaimer, the term of this patent is extended or adjusted under 35 U.S.C. 154(b) by 76 days.

(21) Appl. No.: 13/218,948

(22) Filed: Aug. 26, 2011

(65) Prior Publication Data

US 2012/0048097 A1 Mar. 1, 2012

(30) Foreign Application Priority Data

Aug. 30, 2010 (JP) ..... 2010-191792
Aug. 4, 2011 (JP) ..... 2011-170808

(51) Int. Cl.
*G10H 1/36* (2006.01)

(52) U.S. Cl.
USPC ..... 84/610; 84/601; 84/603; 84/609; 84/634; 84/649; 84/650; 84/666

(58) Field of Classification Search
None
See application file for complete search history.

(56) References Cited

U.S. PATENT DOCUMENTS

| | | | |
|---|---|---|---|
| 5,138,925 | A | 8/1992 | Koguchi et al. |
| 5,347,478 | A | 9/1994 | Suzuki et al. |
| 5,804,754 | A | 9/1998 | Iwase et al. |
| 2009/0019992 | A1 | 1/2009 | Mizuhiki et al. |

FOREIGN PATENT DOCUMENTS

| | | | |
|---|---|---|---|
| JP | 03-036599 | A | 2/1991 |
| JP | 05-166344 | A | 7/1993 |
| JP | 11-288289 | A | 10/1999 |
| JP | 2002-207485 | A | 7/2002 |

*Primary Examiner* — Marlon Fletcher
(74) *Attorney, Agent, or Firm* — Renner, Otto, Boisselle & Sklar, LLP

(57) ABSTRACT

A music sound generation apparatus generates music-sound data based on sound source data, and outputs the music-sound data in synchronization with audio data obtained separately from the music-sound data. A channel assigner assigns a predetermined number of channels to the audio data and the music-sound data. A read control unit reads the audio data and the music-sound data in accordance with their assigned channels. A signal processing unit generates predetermined music by controlling the sound level of the read audio data and the read music-sound data on each assigned channel and mixing the audio data and the music-sound data. When detecting no unoccupied channel, the channel assigner determines, as an unoccupied channel, a channel selected from channels excluding the channel to which the audio data has been assigned. The signal processing unit performs sound elimination on the unoccupied channel.

4 Claims, 6 Drawing Sheets

| CH No. | Assign flag | Data type | Pitch information |
|---|---|---|---|
| 0 | 1 | 1 | 0 |
| 1 | 1 | 0 | A3 |
| 2 | 0 | 0 | 0 |
| 3 | 0 | 0 | 0 |
| ------ | ------ | ------ | ------ |
| 31 | 0 | 0 | 0 |

FIG. 2

MUSIC SOUND GENERATION APPARATUS, MUSIC SOUND GENERATION SYSTEM, AND MUSIC SOUND GENERATION METHOD

CROSS-REFERENCE TO RELATED APPLICATIONS

This application claims priority to Japanese Patent Applications No. 2010-191792 filed on Aug. 30, 2010 and No. 2011-170808 filed on Aug. 4, 2011. The entire disclosure of Japanese Patent Applications No. 2010-191792 and No 2011-170808 is hereby incorporated herein by reference.

BACKGROUND

1. Technical Field

The technology disclosed herein relates to a music sound generation apparatus for generating music sound in accordance with a musical performance operation performed on, for example, a keyboard, while also replaying audio.

2. Background Information

A music sound generation system known in the art allows the user to play a musical composition to its musical performance data, which is stored in a recording medium such as a compact disc. FIG. 6 shows an example of such a conventional music sound generation system (see, for example, Japanese Unexamined Patent Publication No. H5-166344). The music sound generation system shown in FIG. 6 includes a music sound generation unit 500 and an audio replay unit 600 as separate functional units. The music sound generation unit 500 includes a music sound processing unit 503, which generates a music-sound signal based on data read from a memory 501 storing sound data and/or other data as well as based on data input via a keyboard 502. The audio replay unit 600 includes an audio processing unit 603, which demodulates musical performance data read from a disc 601 in accordance with an operation of a replay button 602, and outputs the resulting data as an audio signal. The music-sound signal and the audio signal are then synchronized as a predetermined operation is performed by the user.

In the conventional music sound generation system described above, the independent processing circuits, or specifically the music sound generation unit 500 and the audio replay unit 600, output the music-sound signal and the audio signal. The conventional system is required to include two processing circuits functioning as the music sound generation unit 500 and the audio replay unit 600. As a result, the conventional system is costly.

SUMMARY

It is therefore an object of the technology disclosed herein to provide a music sound generation apparatus, a music sound generation system, and a music sound generation method that use a simple structure to simultaneously generate music sound and replay audio.

One aspect of a music sound generation apparatus disclosed herein is adapted to generate music-sound data based on sound source data and output the music-sound data in synchronization with audio data obtained separately from the music-sound data. The apparatus includes a channel assigner, a read control unit, and a signal processing unit. The channel assigner assigns, out of a predetermined number of channels, at least one channel to the audio data and a plurality of channels to the music-sound data. The read control unit reads the audio data and the music-sound data in accordance with the assigned channels. The signal processing unit generates predetermined music by processing the read audio data and the read music-sound data through sound level control performed on each channel assigned to the audio data and each channel assigned to the music-sound data and through mixing processing performed on the audio data and the music-sound data. When detecting no unoccupied channel, the channel assigner determines, as an unoccupied channel, a channel selected from channels excluding the at least one channel assigned to the audio data. The signal processing unit performs sound elimination on the channel that has been determined as the unoccupied channel by the channel assigner.

Another aspect of the music sound generation apparatus disclosed herein includes a channel assigner that assigns, out of a predetermined number of channels, at least one channel to audio data and a plurality of channels to music-sound data, a read control unit configured to read the audio data and the music-sound data in accordance with the assigned channels, and a signal processing unit configured to generate predetermined music through mixing processing on the read audio data and the read music-sound data. In this apparatus, the signal processing unit performs effects processing exclusively on each channel that has been assigned to the music-sound data, and prevents the effects processing from being performed on the at least one channel that has been assigned to the audio data.

The present invention provides a music sound generation apparatus, a music sound generation system, and a music sound generation method that use a simple structure to simultaneously generate music sound and replay audio.

BRIEF DESCRIPTION OF THE DRAWINGS

FIG. 2 shows a memory map of a channel register 131 according to the embodiment.

DETAILED DESCRIPTION OF THE EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

1. Embodiment

Figure 1:
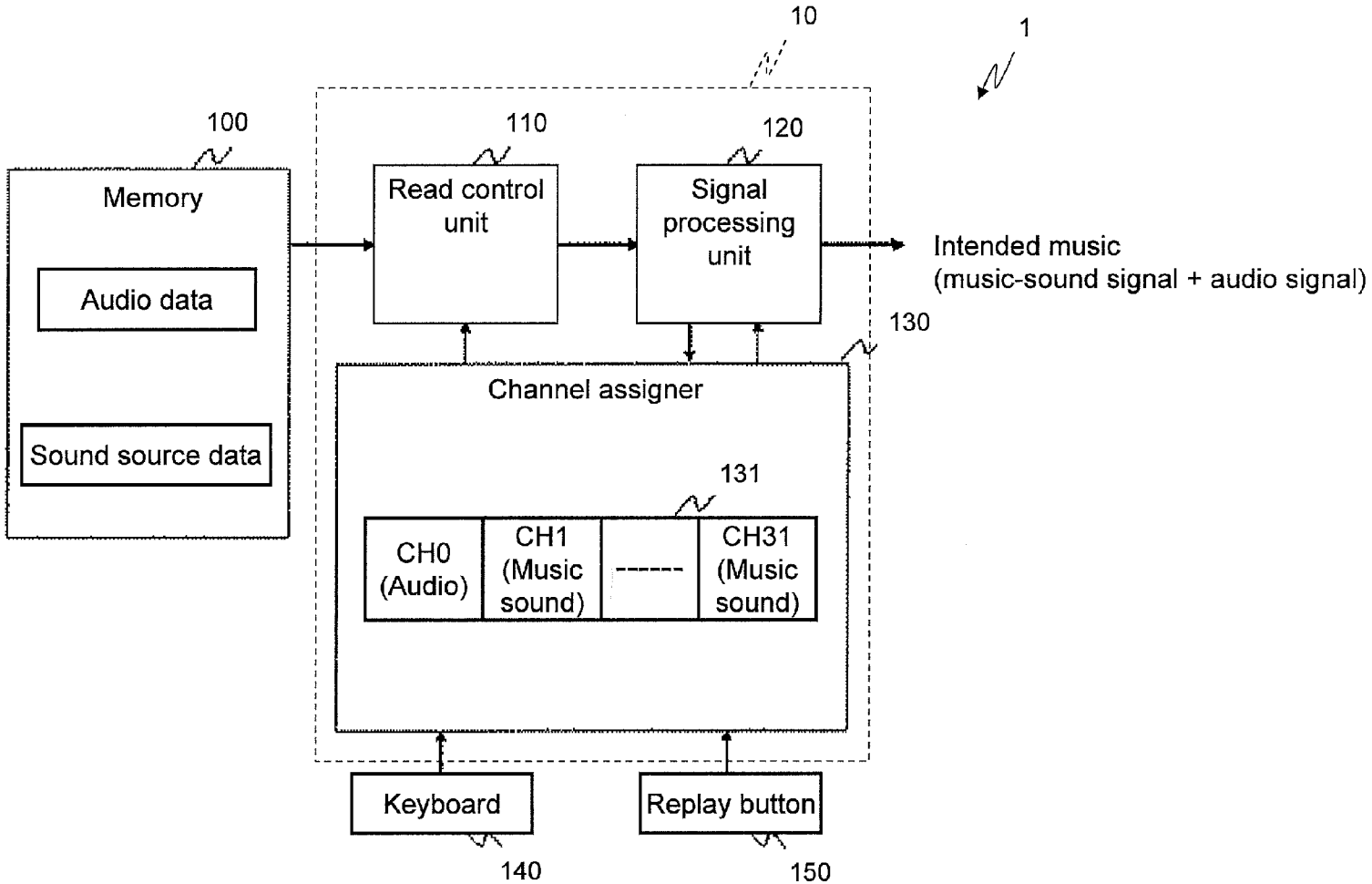
FIG. 1 is a block diagram schematically showing the structure of a music sound generation system according to an embodiment of the present invention.

FIG. 1 schematically shows the structure of a music sound generation system 1 according to an embodiment of the present invention. In this example, the music sound generation system 1 is used in an electronic piano.

In the present embodiment, a "channel" refers to a sound generation channel defined in the field of music sound generation using typical digital electronic instruments. It specifically refers to a channel assigned to every single key stroke operation. A channel may be hereafter abbreviated as CH.

1.1 Structure of the Music Sound Generation System

As shown in FIG. 1, the music sound generation system 1 includes a memory 100, a read control unit 110, a signal processing unit 120, a channel assigner 130, a keyboard 140 on which a musical performance operation is performed, and a replay button 150 used to provide an audio replay instruction. The read control unit 110, the signal processing unit 120, and the channel assigner 130 constitute a music sound generation apparatus 10.

The memory 100 stores audio data, such as musical performance data, which may be obtained from a music CD (compact disc) or from other external media, and also stores sound source data, which may be obtained from a sampling CD. The audio data and the sound source data stored in the memory are both uncompressed data.

For a piano for example, the sound source data is obtained by recording the sound generated when each of the 88 keys is struck, or the sound corresponding to each of the 88 pitches. The audio data and/or the sound source data may be the data recorded by the user.

The read control unit 110 accesses the audio data stored in the memory 100 and reads an audio signal in accordance with a read command provided from the channel assigner 130. The read control unit 110 also accesses the sound source data stored in the memory 100 and generates a music-sound signal corresponding to a key stroke based on the sound source data, and reads the generated music-sound signal. The read control unit 110 transmits the read audio signal and the read music-sound signal to the signal processing unit 120.

The channel assigner 130 includes a channel register 131. The channel assigner 130 assigns channels to the audio signal and the music-sound signal.

FIG. 2 shows a memory map for the channel register 131. In the memory map, the assign flag indicates whether the channel has been assigned to an audio signal or to a music-sound signal. For example, the assign flag is set to 1 when the channel has been assigned to an audio signal or to a music-sound signal. The data type is set to 1 when the channel has been assigned to an audio signal, and to 0 when the channel has been assigned to a music-sound signal, for example. The pitch information is set for the channel for which a key stroke operation on the keyboard 140 is performed. The pitch information corresponds to the position at which the key is struck. When, for example, a key A3 (at 440 Hz) is struck, the pitch information may be A3 as shown in FIG. 2 (for example, A indicates the "la" note, and 3 indicates the octave). Any symbol and numeral that can exclusively identify a different pitch may actually be used as the pitch information. In the initial status, all the values in the memory map are set at zeros.

The signal processing unit 120 processes a signal provided from the read control unit 110 through predetermined signal processing in accordance with a command provided from the channel assigner 130, and outputs the resulting data as intended music.

Figure 3:
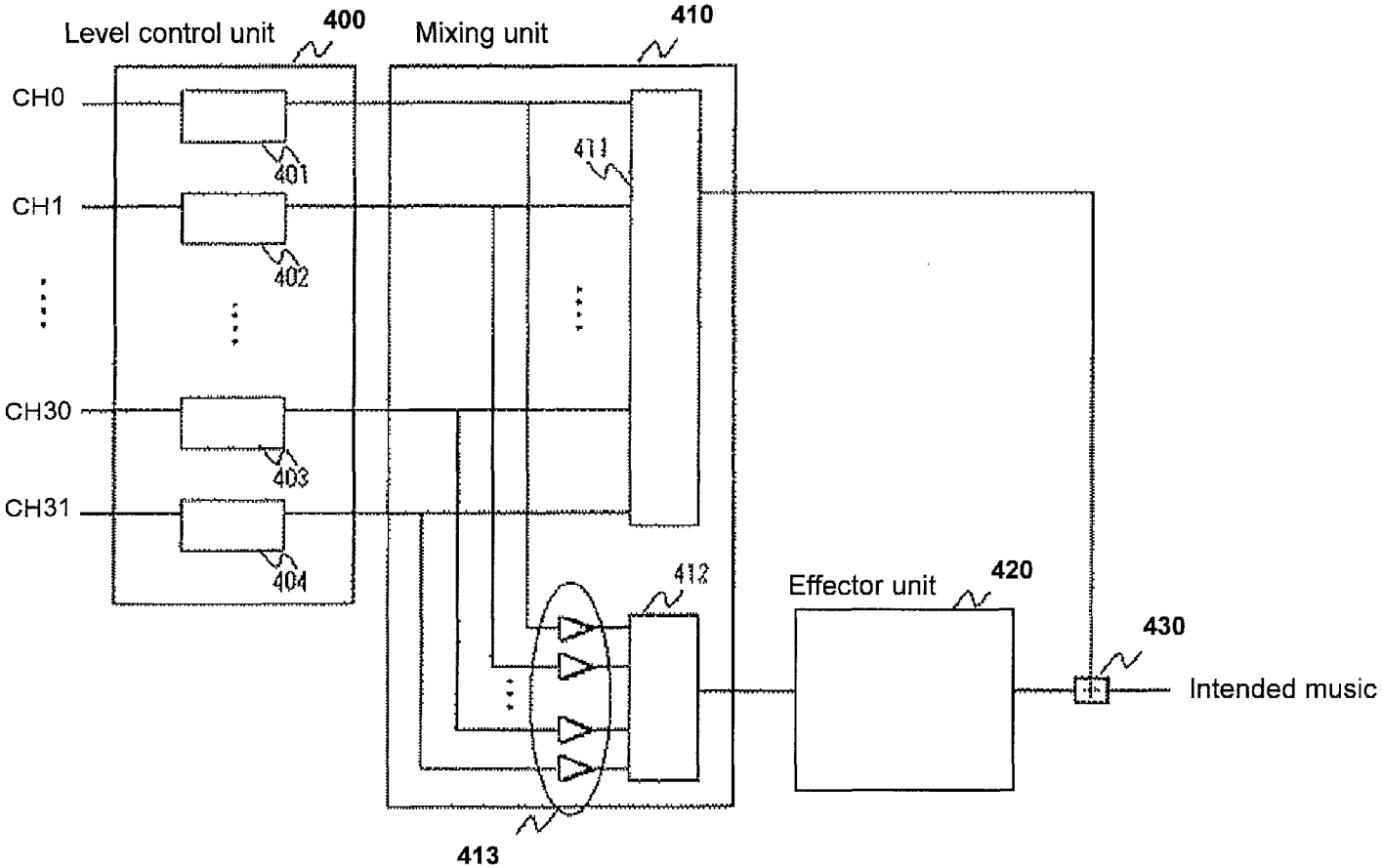
FIG. 3 is a block diagram showing the structure of a signal processing unit 120 according to the embodiment.

FIG. 3 is a block diagram showing the structure of the signal processing unit 120. The signal processing unit 120 includes a level control unit 400, a mixing unit 410, an effector unit 420, and an adder 430.

The level control unit 400 includes level control circuits 401 to 404 to change the sound level of each channel. The level control unit 400 controls the sound level of each channel. More specifically, the level control unit 400 may eliminate sound on one channel, or may control the sound level of one channel to attenuate gradually while preventing the sound level from changing drastically.

The mixing unit 410 includes an accumulator 411, which calculates a sum of signals on the channels CH0 to CH31, and also includes an accumulator 412, which calculates a sum of signals obtained by gain control of the signals on the CH0 to CH31 performed by a multiplier group 413.

The effector unit 420 receives a signal output from the multiplier group 413, and performs effects processing of the signal. The effects processing refers to processing to improve the quality of the original sound. The effects processing includes reverb, delay, echo, chorus, and the equalizer effect. and add various effects to the sound The adder 430 adds an output signal from the accumulator 411 and an output signal from the effector unit 420, and outputs the resulting data as intended music.

1.2 Operation of the Music Sound Generation System

The operation of the music sound generation system 1 of the present embodiment with the above-described structure will now be described.

The entire operation will now be described with reference to FIG. 1. Referring now to FIG. 1, the replay button 150 is pressed by the user, and then the channel assigner 130 starts searching for an unoccupied channel based on the state of the channel register 131. When, for example, the channel CH0 is unoccupied, the channel assigner 130 assigns the channel CH0 as an audio channel. The channel assigner 130 transmits a command for reading the channel CH0 to the read control unit 110. The read control unit 110 reads the channels CH0 to CH31 in a time sharing manner within a single sampling period. More specifically, while the channel CH0 is being read by the read control unit 110, the first sample of the audio signal is read, and the read first sample of the audio signal is transferred to the signal processing unit 120. In this manner, the samples of the audio signal are read sequentially from the first sample in a manner that one sample is read at every sampling timing while the channel is being read by the read control unit 110, and the read samples of the audio signal are sequentially input into the signal processing unit 120. The audio signal is then processed by the signal processing unit 120.

For a music-sound signal, the channel assigner 130 also searches for an unoccupied channel based on the state of the channel register 131 in accordance with a musical performance operation performed on the keyboard 140, or specifically a key stroke operation performed on the keyboard 140, and assigns the detected unoccupied channel, for example, the channel CH1, as a music sound channel. The channel assigner 130 then transmits a command for reading the channel CH1 to the read control unit 110. While the channel CH1 is being read by the read control unit 110, the first sample of the music-sound data is read based on the sound source data corresponding to the position at which the key is struck, or corresponding to the pitch, and the read first sample of the music-sound signal is transferred to the signal processing unit 120. In this manner, the samples of the music-sound signal are read sequentially from the first sample in a manner that one sample is read at every sampling timing while the channel is being read by the read control unit 110, and the read samples of the music-sound signal are sequentially input into the signal processing unit 120. The music-sound signal is then processed by the signal processing unit 120.

The audio signal and the music-sound signal are then added by the signal processing unit 120. The resulting data is then output as intended music.

Through the above processing, the audio signal and the music-sound signal are replayed simultaneously.

1.3 Processing Performed by the Music Sound Generation System

Figure 4:
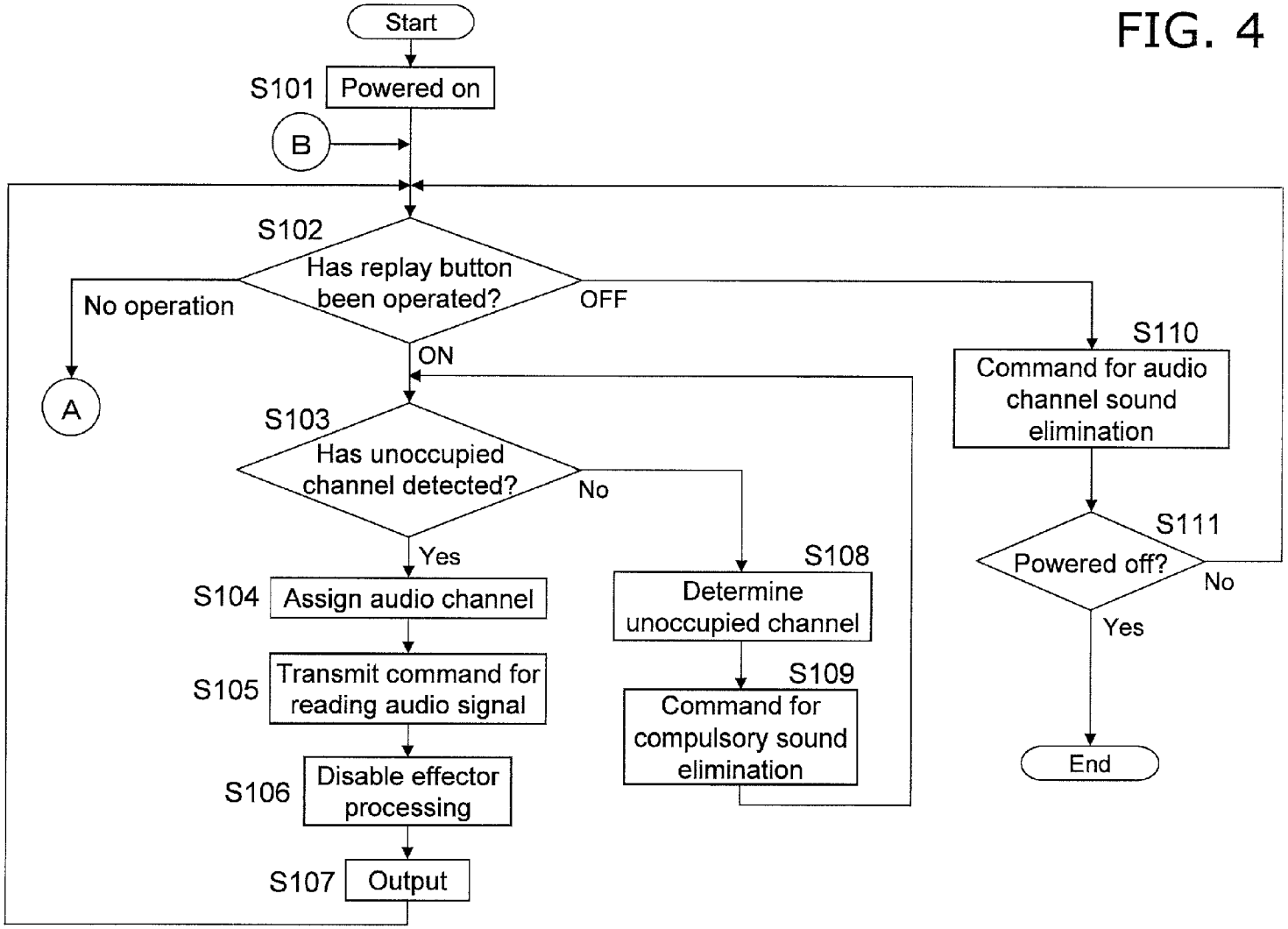
FIG. 4 is a flowchart showing a music sound generation process according to the embodiment.
Figure 5:
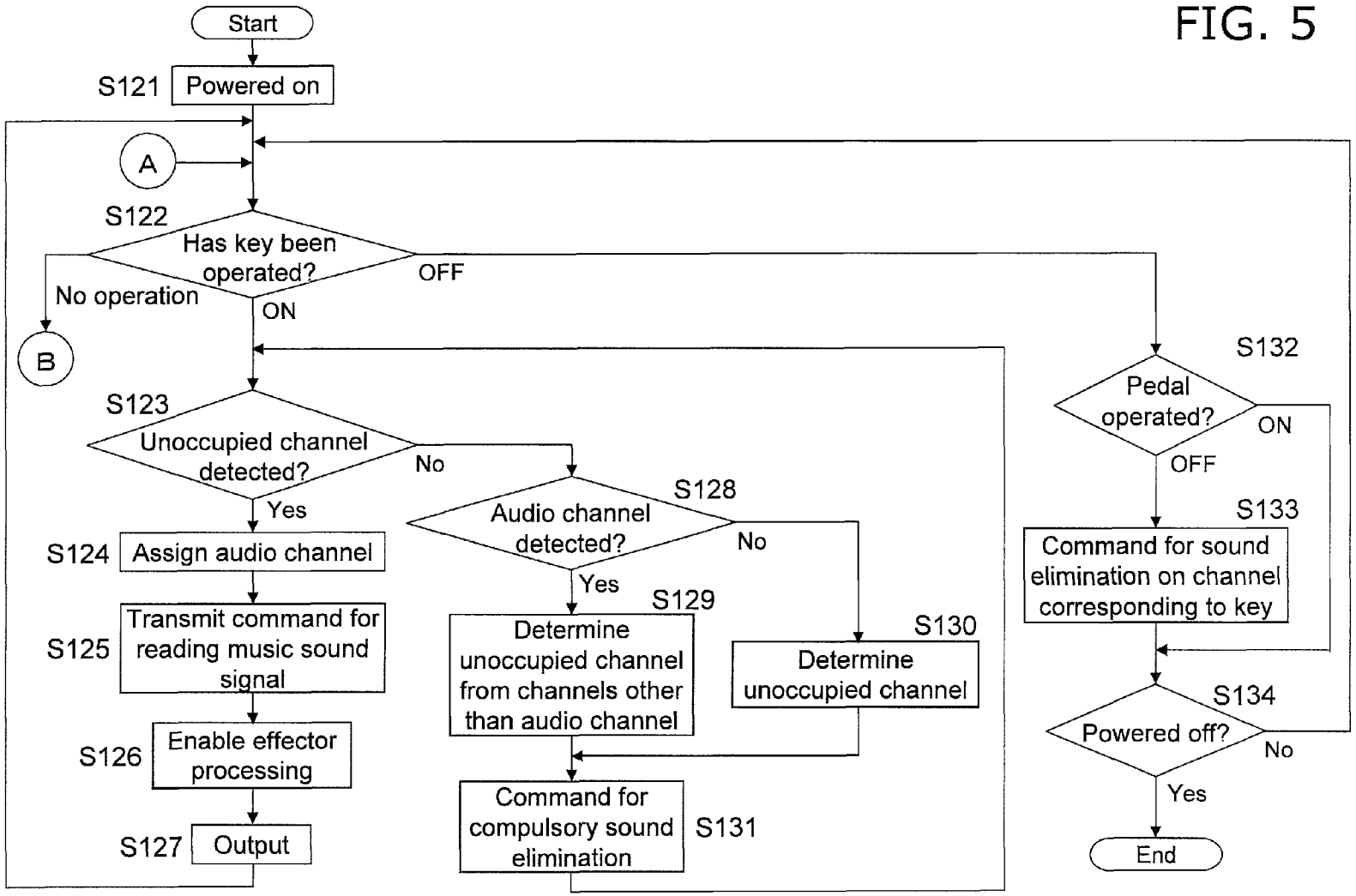
FIG. 5 is a flowchart showing a music sound generation process according to the embodiment.
Figure 6:
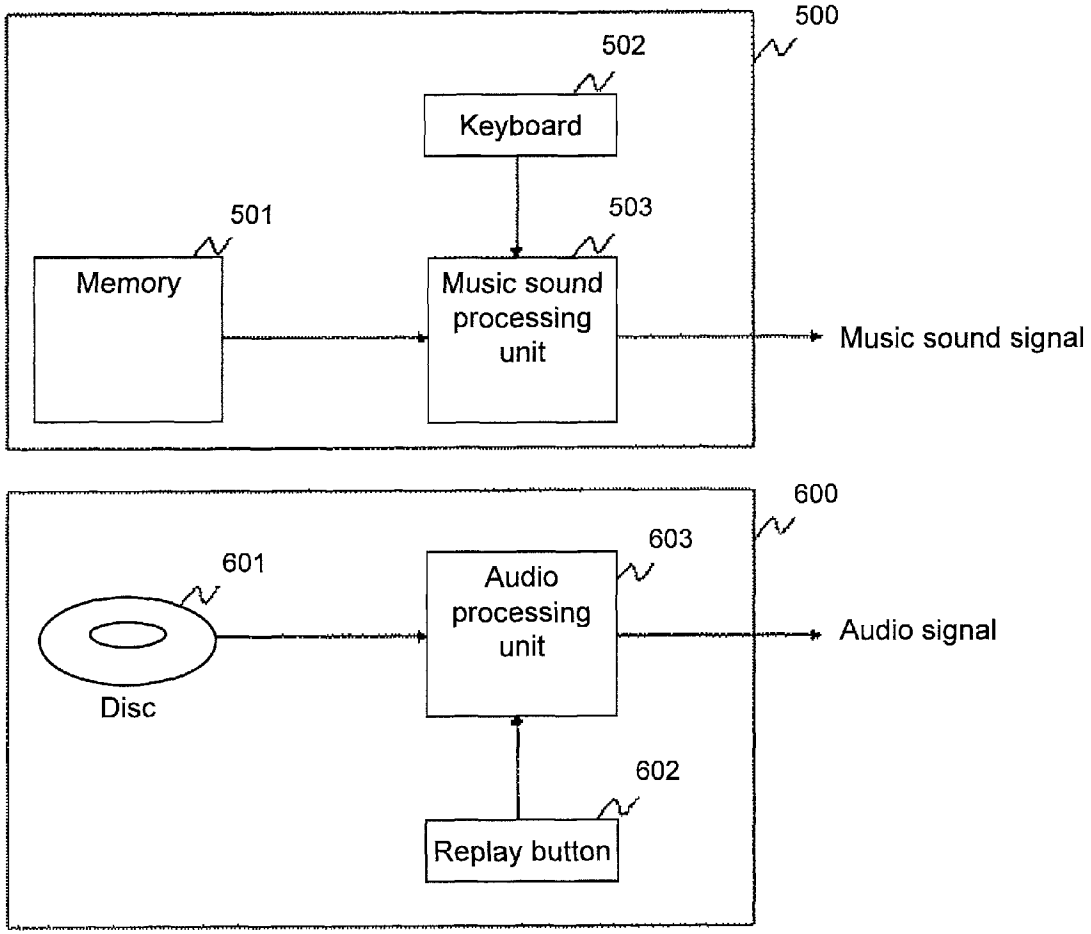
FIG. 6 is a block diagram showing the structure of a conventional music sound generation system.

FIG. 4 and FIG. 5 show an example of the channel assigning process performed by the channel assigner 130 and the signal processing performed by the signal processing unit 120. This process will now be described in detail with additional reference to FIGS. 1 to 3. For ease of explanation, the channel assigner 130 assigns only a single channel as an audio channel in the present embodiment. In this case, a plurality of audio signals are not replayed at the same time.

1.3.1 Audio Signal Processing

Steps S101 to S111 in FIG. 4 form the processing for an audio signal performed in the present embodiment.

Step S101:

The music sound generation system 1 is powered on.

Step S102:

The channel assigner 130 detects an operation performed on the replay button 150. When the channel assigner 130 detects that the replay button 150 has been turned on, the processing advances to step S103. When the channel assigner 130 detects that the replay button 150 has been turned off, the processing advances to step S110. When the channel assigner 130 detects no operation performed on the replay button 150, the processing advances to step S122 in FIG. 5 (in which the on and off operation on the keyboard is detected), which will be described later.

Step S103:

The channel assigner 130 searches for an unoccupied channel based on the state of the channel register 131. For example, the channel assigner 130 checks channels in the ascending order of their channel numbers using the memory map shown in FIG. 2 and searches for a channel number for which the assign flag indicates 0. When the channel assigner 130 detects an unoccupied channel, the processing advances to step S104. When the channel assigner 130 detects no unoccupied channel, the processing advances to step S108.

Step S104:

The channel assigner 130 assigns an audio channel. In the example shown in FIG. 2, the channel assigner 130 determines the channel CH0 as an audio channel when the assign flag for the channel CH0 is 0. In this case, the channel assigner 130 sets the assign flag to 1 and the data type to 1 for CH0. An audio signal needs no pitch information. Thus, the channel assigner 130 does not set the value of the pitch information. The value of the pitch information therefore remains 0 for CH0.

Step S105:

The channel assigner 130 then transmits a command for reading an audio signal to the read control unit 110. The channel assigner 130 further transmits a command for generating sound to the signal processing unit 120. As a result, an audio signal is input into the signal processing unit 120.

Step S106:

The signal processing unit 120 receives the sound generation command, and sets the level of the level control circuit 401 corresponding to the channel CH0 shown in FIG. 3 to a maximum value. The signal processing unit 120 further sets, to 0, a multiplication coefficient used in a multiplier corresponding to the channel CH0 in the multiplier group 413 shown in FIG. 3. This prevents the audio signal output from the channel CH0, among all the signals output from multiplier group 413, from being input into the effector unit 420.

An audio signal is normally processed through the effects processing (for example, reverb) when the music is composed and recorded onto a recording medium, such as a CD. Thus, the audio signal should not be subjected to further effects processing in the music sound generation system 1 because such effects processing performed for the second time will produce unfavorable sound. To prevent the audio signal from being subjected to further effects processing, the multiplier group 413 uses the setting to prevent the effects processing from being performed for an audio channel.

Step S107:

The signal obtained by the accumulator 411 and the signal obtained by the accumulator 412 are added up by the adder 430. The resulting data is then output as intended music.

Step S108:

When detecting no unoccupied channel in step S103, the channel assigner 130 selects one of the channels CH0 to CH31 and determines the selected channel as an unoccupied channel.

In this case, the channel assigner 130 may constantly select the channel CH0 as an unoccupied channel, or may select a different one of the channels cyclically as an unoccupied channel. Alternatively, the channel assigner 130 may preferentially select a channel with the lowest sound level as an unoccupied channel. Selecting the channel with the lowest sound level as an unoccupied channel is preferable because sound elimination performed on the channel with the lowest sound level least affects the resulting sound. To select the channel with the lowest sound level, for example, the signal processing unit 120 may include a circuit that detects the sound level of all the channels.

Step S109:

The channel assigner 130 may select, for example, the channel CH31 as an unoccupied channel, and then transmits a command for compulsorily eliminating sound on the channel CH31 to the signal processing unit 120. The signal processing unit 120 uses the level control circuit 404 shown in FIG. 3 to control the level of the signal on the channel to attenuate compulsorily. The level control circuit 404 subsequently notifies the channel assigner 130 that the signal level has attenuated sufficiently. When receiving this notification, the channel assigner 130 changes the assign flag for the channel CH31 from 1 to 0 in the channel register 131. This sets the channel CH31 to an unoccupied status. The processing then returns to step S103. The channel assigner 130 detects the channel CH31 as an unoccupied channel, and performs the processing in steps S104 to S107 for the channel CH31.

Step S110:

When detecting that the replay button has been turned off in step S102, the channel assigner 130 transmits, to the signal processing unit 120, a command for eliminating sound on the channel that has been already assigned as an audio channel. When the channel CH0 is assigned as an audio channel, the signal processing unit 120 uses the level control circuit 401 shown in FIG. 3 to control the level of the signal on this channel to attenuate, and transmits the audio signal to the mixing unit 410. The level control circuit 401 subsequently notifies the channel assigner 130 that the signal level has attenuated sufficiently. When receiving this notification, the channel assigner 130 changes the assign flag for the channel CH0 from 1 to 0 in the channel register 131. This sets the channel CH0 to an unoccupied status.

Step S111:

The system is powered off to complete the processing.

1.3.2 Music-Sound Signal Processing

Steps S121 to S134 in FIG. 5 form the processing for a music-sound signal performed in the present embodiment. The processing is performed continuously from or in parallel with the processing associated with generation of an audio signal shown in FIG. 4, except for the power-on and the power-off of the music sound generation system 1.

Step S121:

The music sound generation system 1 is powered on.

Step S122:

The channel assigner 130 detects a key stroke operation performed on the keyboard 140. When the channel assigner 130 detects that a key has been turned on (a key has been pressed), the processing advances to step S123. When the channel assigner 130 detects that a key has been turned off (a key has been released), the processing advances to step S132. When the channel assigner 130 detects no operation performed on the keyboard, the processing advances to step S102 shown in FIG. 4 (in which the on and off operation of the replay button is detected).

Step S123:

The channel assigner 130 searches for an unoccupied channel based on the state of the channel register 131. For example, the channel assigner 130 checks channels in the ascending order of their channel numbers using the memory map shown in FIG. 2, and searches for a channel number for which the assign flag indicates 0. When the channel assigner 130 detects an unoccupied channel, the processing advances to step S124. When the channel assigner 130 detects no unoccupied channel, the processing advances to step S128.

Step S124:

The channel assigner 130 assigns a music sound channel. In the example shown in FIG. 2, the channel assigner 130 determines the channel CH1 as a music sound channel when the assign flag for the channel CH1 is 0. In this case, the channel assigner 130 sets the assign flag to 1, and the data type to 0 for the channel CH1. The channel assigner 130 further sets the notation expressing the pitch of the key that has been struck (for example, "A3" as described above) as the pitch information. Any notation that can exclusively identify a different pitch can be used. For example, any symbol or any numeral that can exclusively identify a different pitch may be used.

Step S125:

The channel assigner 130 then transmits a command for reading a music-sound signal to the read control unit 110. The channel assigner 130 further transmits a command for generating sound to the signal processing unit 120. As a result, a music-sound signal generated based on the sound source data read in accordance with the key stroke is input into the signal processing unit 120.

Step S126:

The signal processing unit 120 receives the sound generation command, and sets the level of the level control circuit 402 corresponding to the channel CH1 shown in FIG. 3 to a maximum value. The signal processing unit 120 further sets a multiplication coefficient used in a multiplier corresponding to the channel CH1 in the multiplier group 413 shown in FIG. 3 to an appropriate value (a value other than 0). As a result, only the music-sound signal from the channel CH1 among the signals output from the multiplier group 413 is input into the effector unit 420. The music-sound signal obtained in the accumulator 412 is processed through the effects processing performed by the effector unit 420.

Step S127:

The signal obtained in the accumulator 411 and the signal obtained in the accumulator 412 are added up by the adder 430. The resulting data is then output as intended music.

Step S128:

When detecting no unoccupied channel in step S123, the channel assigner 130 detects whether the channels CH0 to CH31 include an audio channel. For example, the channel assigner 130 detects that the channel CH0, for which the assign flag is set to 1 and the data type is set to 1, is an audio channel using the map shown in FIG. 2. When the channel assigner 130 detects an audio channel, the processing advances to step S129. When the channel assigner 130 detects no audio channel, the processing advances to step S130.

Step S129:

The channel assigner 130 selects one of the channels CH0 to CH31 excluding the audio channel, and determines the selected channel as an unoccupied channel. For example, the channel assigner 130 selects an unoccupied channel from the channels CH1 to CH31 excluding the channel CH0 that has been assigned as an audio channel. The channel assigner 130 selects an unoccupied channel with the same method as described above for an audio signal (step S108 in FIG. 4).

Step S130:

The channel assigner 130 determines an unoccupied channel from the channels CH0 to CH31. The channel assigner 130 determines an unoccupied channel with the same method as described above for an audio signal (step S108 in FIG. 4).

Step S131:

The channel assigner 130 may select, for example, the channel CH30 as an unoccupied channel, and then transmits a command for compulsorily eliminating sound on the channel CH30 to the signal processing unit 120. The signal processing unit 120 uses the level control circuit 403 shown in FIG. 3 to control the level of the signal to attenuate compulsorily. The level control circuit 403 subsequently notifies the channel assigner 130 that the signal level has attenuated sufficiently. When receiving this notification, the channel assigner 130 changes the assign flag for the channel CH30 from 1 to 0 in the channel register 131. This sets the channel CH30 to an unoccupied status. The processing then returns to step S123. The channel assigner 130 detects the channel CH30 as an unoccupied channel, and performs the processing in steps S124 to S127 for the channel CH30.

Step S132:

When detecting that the key is turned off in step S122, the channel assigner 130 further detects whether the pedal of the piano is on or off. When the channel assigner 130 detects that the pedal is off, the processing advances to step S133. When the channel assigner 130 detects that the pedal is on, the processing advances to step S134.

When the pedal is on, the reverberation including echo caused by the pedal operation needs to be sustained. In this case, sound elimination is not performed on the channel corresponding to the key.

For the piano used in this example, the on and off operation of the pedal is an example of the operation that causes the reverberation. The operation that causes the reverberation should not be limited to the pedal operation in other electronic instruments.

Step S133:

When detecting that the pedal is off in step S132, the channel assigner 130 transmits a command for eliminating sound on the channel corresponding to the key to the signal processing unit 120. More specifically, the channel assigner 130 searches for a channel having the same pitch information as a key that is off among the channels for which the assign flag is set at 1 in the channel register 131, and determines the detected channel as the channel corresponding to the key. The channel assigner 130 transmits a command for eliminating sound on the corresponding channel to the signal processing unit 120. When, for example, the command for eliminating sound on the channel CH1 is transmitted, the signal processing unit 120 uses the level control circuit 402 shown in FIG. 3 to control the level of the music-sound signal to attenuate, and transmits the resulting signal to the mixing unit 410. The level control circuit 402 subsequently notifies the channel assigner 130 that the signal level has attenuated sufficiently.

When receiving this notification, the assign flag for the channel CH1 is changed from 1 to 0 in the channel register 131. This sets the channel CH1 to an unoccupied status.

When the pedal state detected in step S132 changes from the on status to the off status, the processing in step S133 may be performed for the channel corresponding to the key.

Step S134:

The system is powered off to complete the processing.

1.4 Advantageous Effects of the Embodiment

In the present embodiment, the channel assigner 130 is able to assign a channel used for sound generation also to audio data. This enables the circuit for music sound generation to simultaneously generate music sound and replay audio while achieving a high sound quality. The user can readily experience playing together with pseudo professional musical performance (audio data).

In the present embodiment, when detecting no unoccupied channel among the channels CH0 to CH31, the channel assigner 130 selects a channel for a music-sound signal from channels excluding a channel assigned to an audio signal. The channel assigner 130 then performs the processing for compulsorily eliminating sound on the selected channel. This prevents the audio replay from being stopped compulsorily due to channel overflow, which can be caused when the number of channels assigned to a music-sound signal increases.

In the present embodiment, the signal processing unit 120 prevents the effects processing to be performed on an audio signal. As a result, an audio signal, which has already been processed through the effects processing, is prevented from being subjected to the effects processing for the second time. This enables music sound with a high sound quality to be produced.

In the present embodiment, the audio data and the sound source data stored in the memory 100 each are uncompressed data. This enables the read control unit 110 to read the audio data and the sound source data promptly without being required to perform the processing for expanding compressed data, and also simplifies the structure of the processing circuit.

2. Other Embodiments 2.1

Although the above embodiment describes the case in which a single channel is used as an audio channel, a plurality of channels may be used as audio channels. Also, although the above embodiment describes the case in which for each channel, a single sample of a signal is read per sampling cycle, a plurality of samples may be read and may be temporarily buffered into a RAM included in the signal processing unit 120.

2.2

Although the above embodiment describes the case in which the sound source data and the audio data each are uncompressed data, the sound source data and/or the audio data may be compressed data stored in the memory 100. In this case, the signal processing unit 120 is required to include an expansion processing unit for expanding the compressed data.

2.3

The number of channels may be more than or less than 32 channels. For example, 64 channels or 128 channels may be used in accordance with the apparatus used or the sound source used.

2.4

Although the above embodiment describes the case in which the music sound generation system 1 is used in the electronic piano, the system may be used in other electronic instruments.

Although the above embodiment describes the case in which the user plays a musical composition to its musical performance data, or audio data read from a music medium such as a music CD, the present invention is also applicable to other systems. The present invention may be applied to a karaoke machine. In this case, a file storing data for instructing the music interval, the strength, and the timings is input into the channel assigner 130. The read control unit 110 generates a music-sound signal from the sound source data stored in the memory 100 in accordance with the file, and assigns a channel to the generated signal.

2.5

Each block of the read control unit 110, the signal processing unit 120, and the channel assigner 130 may be formed using a single chip with a semiconductor device, such as LSI, or some or all of the blocks of the read control unit, the signal processing unit, and the channel assigner may be formed using a single chip.

Although LSI is used as the semiconductor device technology, the technology may be an IC (integrated circuit), a system LSI, a super LSI, or an ultra LSI depending on the degree of integration of the circuit.

The circuit integration technology employed should not be limited to LSI, but the circuit integration may be achieved using a dedicated circuit or a general-purpose processor. A field programmable gate array (FPGA), which is an LSI circuit programmable after manufactured, or a reconfigurable processor, which is an LSI circuit in which internal circuit cells are reconfigurable or more specifically the internal circuit cells can be reconnected or reset, may be used.

Further, if any circuit integration technology that can replace LSI emerges as an advancement of the semiconductor technology or as a derivative of the semiconductor technology, the technology may be used to integrate the functional blocks. Biotechnology is potentially applicable.

All or part of the processes performed by the functional blocks described in the above embodiment may be implemented using programs. All or part of the processes performed by the functional blocks described in the above embodiment is implemented by a central processing unit (CPU) included in a computer. The programs for those processes are stored in a memory device such as a hard disk or a ROM, and are read into a ROM or a RAM and implemented.

The processes described in the above embodiment may be implemented using either hardware or software (which may be combined together with an operating system (OS), middleware, or a predetermined library), or may be implemented using both software and hardware. When each of the music sound generation apparatus and the music sound generation system of the above embodiment is implemented by hardware, the music sound generation apparatus and the music sound generation system require timing adjustment for their processes. For ease of explanation, the timing adjustment associated with various signals required in an actual hardware design is not described in detail in the above embodiment.

The processes described in the above embodiment may not be performed in the order specified in the above embodiment. The order in which the processes are performed may be changed without departing from the scope and the spirit of the invention.

The present invention may also include a computer program enabling a computer to implement the method described in the above embodiment and a computer readable recording medium on which such a program is recorded. The computer readable recording medium may be, for example, a flexible disk, a hard disk, a CD-ROM, an MO, a DVD, a DVD-ROM, a DVD-RAM, a Blu-ray disc, or a semiconductor memory.

The computer program should not be limited to a program recorded on the recording medium, but may be a program transmitted with an electric communication line, a radio or cable communication line, or a network such as the Internet.

The specific structures described in the above embodiment are mere examples of the present invention, and may be changed and modified variously without departing from the scope and the spirit of the invention.

The present invention is implementable not only as the music sound generation apparatus and the music sound generation system but also as the music sound generation method implementing the above processes.

The present invention is applicable to an electronic instrument, a karaoke machine, or a personal computer and a mobile telephone having a music sound generation function (a sound card for example).

General Interpretation of Terms

In understanding the scope of the present disclosure, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives.

The term "configured" as used herein to describe a component, section, or part of a device includes hardware and/or software that is constructed and/or programmed to carry out the desired function.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

REFERENCE SIGNS LIST

100 memory
110 read control unit
120 signal processing unit
130 channel assigner
140 key
150 replay button
400 level control unit
401, 402, 403, and 404 level control circuit
411, 412 accumulator
413 multiplier group
410 mixing unit
420 effector unit
430 adder

What is claimed is:

1. A music sound generation apparatus for generating music-sound data based on sound source data, and outputting the music-sound data in synchronization with audio data obtained separately from the music-sound data, the apparatus comprising:

a channel assigner configured to assign, out of a predetermined number of channels, at least one channel to the audio data and a plurality of channels to the music-sound data;

a read control unit configured to read the audio data and the music-sound data in accordance with the assigned channels; and a signal processing unit configured to generate predetermined music by processing the read audio data and the read music-sound data through sound level control performed on each channel assigned to the audio data and each channel assigned to the music-sound data and through mixing processing performed on the audio data and the music-sound data, wherein when detecting no unoccupied channel, the channel assigner determines, as an unoccupied channel, a channel selected from channels excluding the at least one channel assigned to the audio data, and the signal processing unit performs sound elimination on the channel that has been determined as the unoccupied channel by the channel assigner.

2. The music sound generation apparatus according to claim 1, wherein at least one of the audio data and the music-sound data is uncompressed data.

3. A music sound generation system, comprising:

the music sound generation apparatus according to claim 1; and a memory storing the audio data and the sound source data, wherein the read control unit reads the audio data from the memory, and generates the music-sound data in accordance with the sound source data and reads the generated music-sound data.

4. A music sound generation method for generating music-sound data based on sound source data, and outputting the music-sound data in synchronization with audio data obtained separately from the music-sound data, the method comprising:

assigning, out of a predetermined number of channels, at least one channel to the audio data and a plurality of channels to the music-sound data;

reading the audio data and the music-sound data in accordance with the assigned channels;

generating predetermined music by processing the read audio data and the read music-sound data through sound level control performed on each channel assigned to the audio data and each channel assigned to the music-sound data and through mixing processing performed on the audio data and the music-sound data;

when no unoccupied channel is detected, determining, as an unoccupied channel, a channel selected from channels excluding the at least one channel assigned to the audio data; and performing sound elimination on the channel that has been determined as the unoccupied channel.

* * * * *